United States Patent [19]

Carpenter, Jr.

[11] 4,370,814

[45] Feb. 1, 1983

[54] WELL TOOL FOR DETECTING WELL BORE DEVIATION IN DRILL STRING

[76] Inventor: William T. Carpenter, Jr., #3 Colony East, Houston, Tex. 77069

[21] Appl. No.: 170,048

[22] Filed: Jul. 18, 1980

[51] Int. Cl.[3] ..... E21B 47/22

[52] U.S. Cl. ..... 33/307

[58] Field of Search ..... 33/306, 307

[56] References Cited

U.S. PATENT DOCUMENTS

| | | | |
|---|---|---|---|
| 2,887,298 | 5/1959 | Hampton | 33/307 |
| 3,077,233 | 2/1963 | Armstrong | 33/307 |
| 3,124,882 | 3/1964 | Black | 33/306 |
| 3,303,573 | 2/1967 | Alder et al. | 33/307 |

*Primary Examiner*—Steven L. Stephan

*Attorney, Agent, or Firm*—Pravel, Gambrell, Hewitt, Kirk & Kimball

[57] ABSTRACT

A well tool for detecting well bore deviation which includes a tool adapted to be connected between adjacent components of a drill string, including a longitudinal opening through which drilling fluid can be circulated. At least one vent hole is located in the tool wall for communicating the longitudinal opening with the space outside the tool through which drilling fluid is circulated back to the surface, the vent hole being selectively blocked and unblocked. The angle the tool has deviated from vertical is measured and the vent is unblocked at a time interval after weight is placed on the bit which is determined by the amount of deviation of the tool, the unblocking of the vent causing a pressure drop in the drilling fluid in the tool the timing of which indicates the amount of deviation.

11 Claims, 7 Drawing Figures

12
10
2
2
66
20
44
41
42
16
53
52
56
50
30
54
3
3
24b
34
24a
24a
36
60
60
46
4
4
68
58
48
26
46a
26a
28a
28
28b
18b
22
18
14

Fig. 2
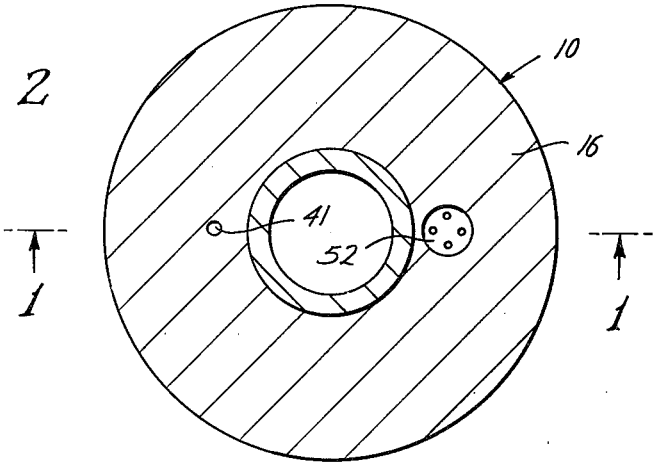
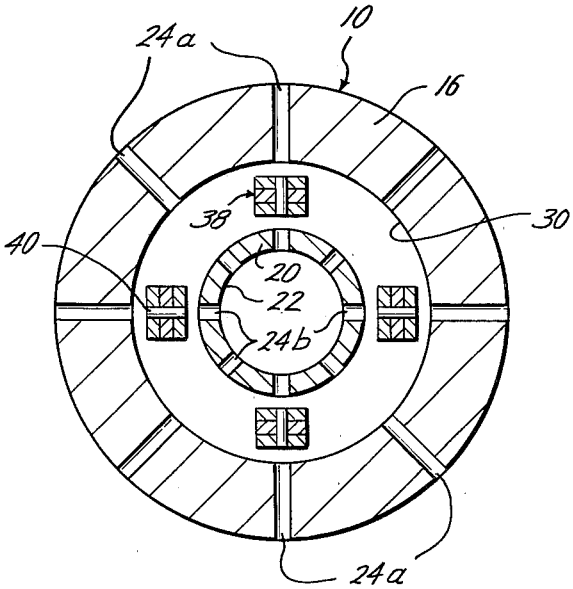
Fig. 3
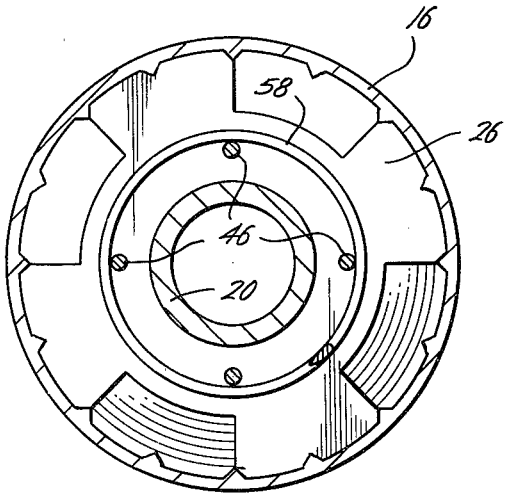
Fig. 4

Fig. 5
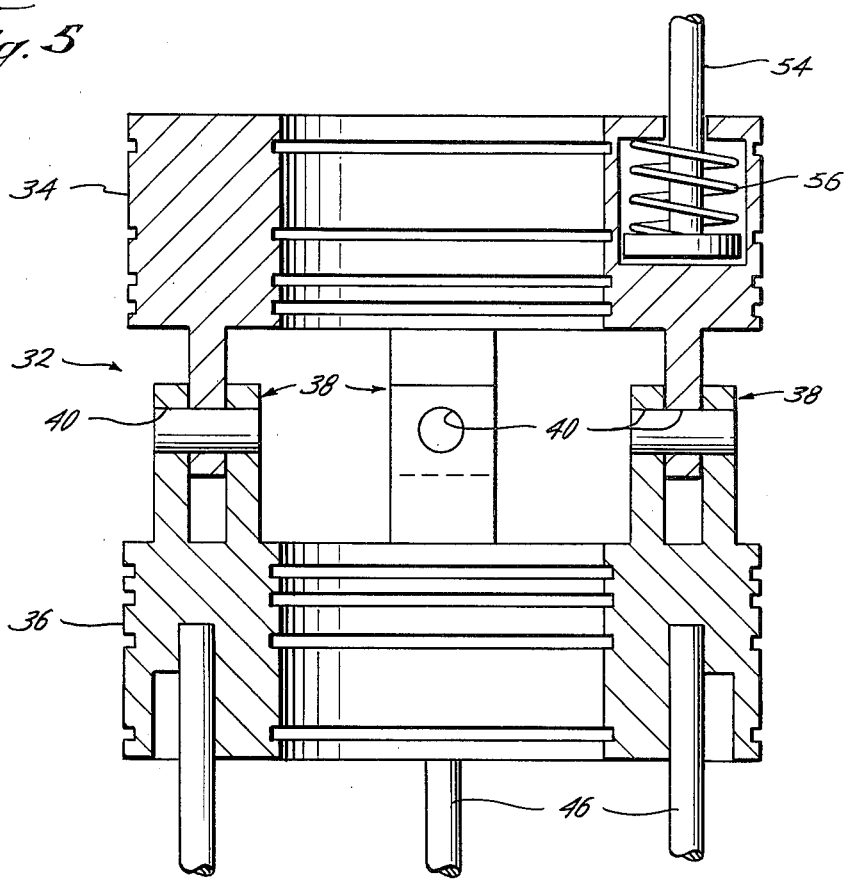
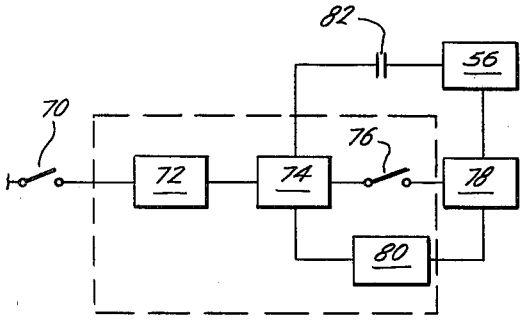
Fig. 7
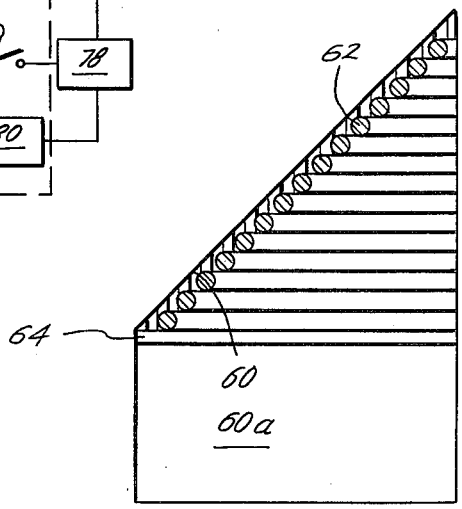
Fig. 6

WELL TOOL FOR DETECTING WELL BORE DEVIATION IN DRILL STRING

BACKGROUND OF THE INVENTION

This invention relates to devices for determining deviation of well bores and, more particularly, to a well tool which can measure the degree of deviation and transmit a signal to the surface indicating the amount of deviation so that an operator can take corrective action.

Many types of well bore deviation measuring devices have been developed. Some of them employ electronic sensors such as, for example, mercury reservoirs and electronic circuitry for determining and measuring well bore deviation and transmitting a signal to the surface by means of wires running through the drill string. Examples of such devices are shown in U.S. Pat. Nos. 3,791,043; 3,791,042; 3,789,510; 3,400,464; 3,252,225; and 2,665,497. In another type of device, a fluid flow control means used to measure deviation is interconnected with electronic circuitry for producing sonic signals which are transmitted to the surface through pipe sections which make up the drill string.

Other types of well bore deviation measuring tools have been developed which utilize means for periodically restricting the flow of drilling fluid for creating pressure pulses in the drilling fluid stream which are transmitted to the surface. These pressure pulses are varied in most cases by a pendulum-type valving mechanism. Examples of such devices are shown in U.S. Pat. Nos. 3,581,404; 3,470,620; 3,457,654; 3,431,654; 3,313,360; and 3,176,407. U.S. Pat. No. 4,120,097 teaches a device which transmits signals from a downhole sensor both in the drilling fluid and through the walls of pipe sections.

SUMMARY OF THE INVENTION

A different type of device for detecting well bore deviation has been developed in accordance with the invention where a single signal in the form of a pressure drop in the drilling fluid at a measurable period after weight is placed on the drill string indicates the amount of deviation. Adjustments in weight exerted on the bit and drilling speed can then be made in response to the signal.

The well tool is adapted to be connected between the drill bit and a length of drill pipe and includes a full bore axial opening through which drilling fluid can be circulated. A plurality of vent holes in the tool communicate the axial opening with the space outside the housing through which drilling fluid is returned to the surface after it circulates through the drill bit. A blocking mechanism in the form of a pair of rings operates to selectively block and unblock the vent holes. A deviation measuring means in the form of a coiled conductor wire located in the upper portion of a mercury reservoir where the mercury is separated from the wire by a non-conductive ring when the drill string is vertically oriented is used to detect the degree of deviation and transmit a current proportional to the number of windings contacted by the mercury when the tool is tilted. The current is transmitted to a timing mechanism which operates to move the blocking means and allow drilling fluid to vent through the vent holes and cause a pressure drop in fluid in the tool which can be detected at the surface. The timing mechanism determines the time interval between when weight is placed on the drill bit and when the blocking means is moved to create the pressure drop which is determined by the current transmitted from the windings. Thus, by measuring the time interval the degree of deviation can be determined.

The well tool includes upper and lower telescoping sections which can be stretched when the bit is raised and compressed when weight is placed on the bit, the vent holes being formed in the upper section. Upper and lower rings form the blocking mechanism and are connected to move together. The rings are located in a chamber formed in the upper section around the axial opening, through which the drilling fluid circulates, the upper ring blocking the vent opening when the telescoping sections are stretched.

A fluid chamber is located above the upper ring, which expands and fills with hydraulic fluid when the tool is stretched and the upper section moves outwardly relative to the lower section. A one-way valve connects the fluid chamber with a fluid reservoir for admitted fluid to the fluid chamber when it expands. The rings are connected to the lower telescoping section and are prevented from moving upwardly with the upper section when the tool stretches.

A helical spring is located between the lower ring and the lower section for urging the rings upwardly, the compressive force of the spring being overcome when weight is placed on the bit and the tool is compressed, causing the upper section to be lowered relative to the lower section with hydraulic fluid in the fluid chamber forcing the rings downwardly. The timing mechanism is operatively connected to a relief valve through a solenoid which operates to open the valve and allow the fluid in the fluid chamber to return to the reservoir at a measurable time interval after weight is placed on the bit, which is determined by the degree the tool has deviated from the vertical. The helical spring operates to move the rings upwardly when the fluid pressure is relieved. When a space between the rings is adjacent to the vent holes, the axial opening communicates outside the housing and causes a pressure drop in drilling fluid in the tool. The lower ring then operates to block the vent holes after the sections are moved to their uppermost position by the spring.

This type of tool provides a simple and effective way of creating a pressure drop in the drilling fluid, the timing of which is determined by the amount of deviation of the tool. Even though the direction of deviation is not known, the timing of the pressure drop indicates the degree of deviation so that appropriate adjustments can be made at the surface.

BRIEF DESCRIPTION OF THE DRAWINGS

A better understanding of the invention can be obtained when the detailed description of a preferred embodiment set forth below is considered in conjunction with the drawings, in which:

FIG. 2 is a section view of the tool shown in FIG. 1 looking along a section line in the direction of arrows designated by reference numerals 2—2;

FIG. 3 is a section view of the well tool of FIG. 1 looking along a section line in the direction of arrows 3—3;

FIG. 4 is a section view of the well tool of FIG. 1 looking along a section line in the direction of arrows 4—4;

FIG. 5 is a plan view partially in section of the upper and lower rings which operate to block and unblock the vent hole;

FIG. 6 is a schematic view of a portion of the cavity in which mercury is contained along with windings of conductive wire for transmitting an electric signal proportional to the amount of deviation of the drill bit; and FIG. 7 is a schematic diagram of the electric circuitry of the deviation sensor and timing mechanism.

DESCRIPTION OF THE PREFERRED EMBODIMENTS

Figure 1:
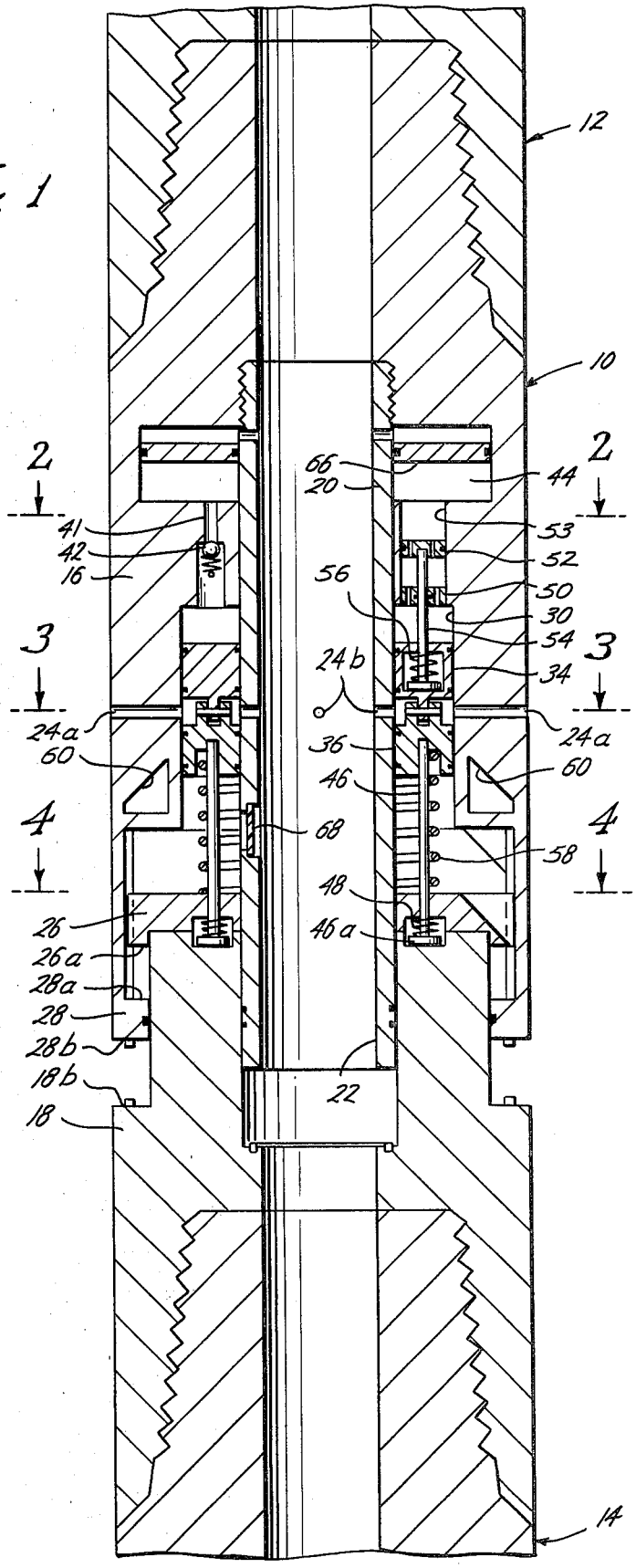
FIG. 1 is a section view of the well tool which embodies the subject invention.

Referring to FIG. 1, reference numeral 10 is used generally to designate the well tool which embodies the present invention and is connected at its upper end to a section of drill pipe 12 and at its lower end to a drill bit 14. The The tool 10 is formed of two separate telescoping sections which are movable relative to each other, an upper section 16 and a lower section 18. A liner or sleeve 20 is threadedly connected to the upper section 16 and defines a central opening 22 through which drilling fluid can be circulated. A plurality of radially disposed pressure relief or vent holes **24*a* and 24*b* are formed in the upper section 16 and the sleeve 20, respectively, for communicating the central opening 22 with the portion of the drill hole (not shown) or annulus outside the sub 10 through which the drilling fluid is returned to the surface after it circulates through the bit 14**.

A stop member 26 is connected at the upper end of the lower section 18, the outer surface of the stop member and inner surface of the upper section 16 containing cooperating lugs or splines for guiding the telescoping movement of the upper section 16 relative to the lower section 18 and resisting torsional movement as is best illustrated in FIG. 4. Suitable sealing rings such as O-rings are provided between relatively movable surfaces which are sufficiently known to those skilled in the art so that no further description of such rings is necessary.

The range of telescoping movement between the sections 16 and 18 is limited by a flange 28 formed at the lower end of the upper section 16. When the upper section 16 is in its uppermost position, an upper surface **28*a* of the flange engages a lower surface 26*a* of the stop member 26, and when the upper section 16 is at its lowermost position relative to the lower section 18 the lowermost surface 28*b* of the flange 28 engages a stepped upwardly facing surface 18*b* formed on the lower section 18. In their positions shown on FIG. 1, the upper section 16 is approximately midway between its uppermost and lowermost positions relative to the lower section 18**.

A chamber 30 is formed between the inner surface of the upper section 16 and the outer surface of the sleeve 20. A sealing ring configuration generally designated by reference numeral 32 and shown in greater detail in FIG. 5 includes an upper ring 34 and a lower ring 36 and is mounted in the chamber 30 as shown in FIG. 1. The upper and lower rings 34 and 36 are mechanically connected together through connector portions generally designated by reference numeral 38, as best shown in FIG. 5, which are connected together by pins (not shown) which extend through complementary openings 40 found in the connector portions. The inner and outer surfaces of the rings 34 and 36 include a plurality of grooves in which appropriate sealing rings can be positioned for providing a fluid-tight seal between the rings and their adjacent surfaces. The rings 34 and 36 move relative to the vent holes **24*a* and 24*b*** for creating a pressure drop in drilling fluid circulating downwardly through the tool, from which the degree of deviation of the tool and consequently the well bore can be determined, in a way described in greater detail below.

The portion of the chamber 30 located above the ring 34 forms a fluid chamber which expands and fills with fluid that flows through a conduit 41 and one-way valve 42 from a reservoir 44 when the upper section 16 moves upwardly relative to the lower section 18. As shown in FIG. 1, the rings 34 and 36 are in their position when the upper section 16 has been extended about half the distance it can move upwardly relative to the lower section 18. This movement occurs when the drill string is lifted so that a new section of drill pipe can be added, the friction between the drill bit 14 and the drill hole (not shown) provide enough resistance so that the upper section 16 moves outwardly relative to the lower section 18 until the contact surfaces **26*a* and 28*a* engage each other. To insure proper tool elongation a spring (not illustrated) may be incorporated for biasing the sections to the extended condition. At this position, the ring 34 is located adjacent to the vent holes 24** and blocking them.

As the upper section 16 moves toward this position, the rings 34 and 36 are prevented from moving upwardly beyond a predetermined distance because a plurality of connecting rods 46 connected to the lower ring 36 are connected through a spring 48 to the stop member 26 and resist further upward movement of the rings when base portions **46*a* which form a slip coupling of the rods 46 engage the stop 26. This allows the vent holes 24 to move upwardly relative to the rings to where the vent holes are blocked by the upper ring 34 as described. As the upper section 16 moves upwardly, a lower valve element 50 which is connected to the upper section 16 moves upwardly with the upper section 16 until it engages a movable upper valve element 52 which is connected to the outer end of a second rod 54 which in turn is connected to the upper ring 34 through a solenoid 56. The valve elements 50 and 52 have non-aligned openings so that when the elements engage each other fluid is prevented from flowing through a conduit 53 back to the reservoir. When the valve elements 50 and 52 are pulled to their closed position the solenoid 56 operates to lock them in place. The portions of the chamber 30 above the valve elements 50 and 52 and below the lower ring 36 are filled with hydraulic fluid and communicate with hydrostatic pressure of the drilling fluid through a floating ring 66 in the reservoir 44 and a diaphragm 68 in the sleeve 20** for equalizing pressure.

After a new pipe section (not shown) has been added to the drill string during the time the tool 10 is stretched as described above, the drill string is lowered until weight is exerted on the bit 14 at which time the upper section 16 moves downwardly relative to the lower section 18. The fluid in the portion of the chamber 30 above the upper ring 34 is prevented from flowing back into the reservoir 44 because the one-way valve 42 blocks the conduit 41 and the valve elements 50 and 52 with their non-aligned openings engage each other blocking the conduit 53 which leads to the reservoir 44. Accordingly, as the upper section 16 moves downwardly pressure exerted by hydraulic fluid in the portion of the chamber 30 above the ring 34 forces the upper and lower rings 34 and 36 downwardly to where the bases **46*a* of the rods 46 engage the stop 26**, overcoming the force of a helical spring 58 which is positioned between the lower ring 36 and the stop 26. As the upper section 16 moves downwardly, the rings 34 and 36 directly or indirectly trip a switch 70 shown in FIG. 7 which, in a way described in greater detail below, activates the solenoid 56 to open the valve elements 50 and 52. Fluid is thus allowed to escape from the portion of the chamber above the ring 34 back into the reservoir which, in turn, allows the helical spring 58 to urge the rings 34 and 36 upwardly past the position shown in FIG. 1 where the central opening 22 briefly communicates outside the tool 10 through the vent holes 24*a* and 24*b* which allows drilling fluid to flow through the vent openings 24 and create a momentary pressure drop in drilling fluid in the tool which causes a simultaneous pressure drop in the pump which increases the pump strokes and can be detected.

This pressure drop only occurs momentarily because the lower ring continues to be moved by the helical spring 58 to where the vent holes 24 are blocked by the lower ring 36. The time interval between when the switch (not shown) which separates the valve elements 50 and 52 is tripped and when the rod 54 is actually moved to separate the valve elements is controlled by a timing circuit described in greater detail below.

The timing circuit includes a sensing device shown in detail in FIG. 6 where a donut-shaped cavity 60 formed in the upper section 16 includes a slanted upper surface, around which a conductive wire 62 of a known unit resistance is continuously wound, each winding being insulated from the tool and from the adjacent windings to provide a relative long length or resistant wire. A quantity of mercury is located in the lower portion 60*a* of the cavity 60. Current is transmitted to the mercury and when the tool 10 is vertically oriented with zero-inclination the mercury is separated from the windings by a non-conductive ring 64 so that no current is transmitted through the wire. At any significant inclination greater than zero, the mercury breaches the ring 64 and contacts the initial winding of the wire 62 for initiating a current flow through the entire length of the wire 62. As the inclination of the tool 10 increases, the mercury contacts the winding 62 at a increasingly higher point which effectively eliminates a determinable portion of the winding to allow a greater amount of electrical current to be transmitted through the wire 62. The system is thus designed so that the current entering the analytic circuitry shown in FIG. 7 is proportional to the inclination of the tool 10.

Referring to FIG. 7, reference numeral 70 indicates the switch which is tripped when the rings 34 and 36 move downwardly relative to the upper section 16, which occurs when weight is removed from the drill bit preferably after the tool is allowed to set to allow the mercury level in the cavity 60 to stabilize. The closed switch allows current to flow from a battery (not shown) through a starter 72 to a counter 74 which allows current to flow through a relay 76 to the mercury indicated by reference numeral 78 after a delay of about one minute. A resistance measuring device 80 receives current from the conductor wire 60 and determines the resistance in the windings and indicates to the counter how long to count, which is preferably set at one minute for every 1° of deviation. After the appropriate interval, current is transmitted to the solenoid 56 for opening the valve elements and allowing the springs to force the sealing rings to move upward, displacing hydraulic fluid from chamber 30 through valve 50 into reservoir 44. The dotted lines represent a circuit which is commercially available and known as a TTL (transistor-transistor-logic) circuit.

Thus, the degree of inclination of the tool can be determined at the surface by measuring the time interval between when weight is placed on the bit 14 and when the pressure drop is detected which indicates to the operator the amount of inclination of the bit so that he can correct the orientation by easing up the pressure and increasing drilling speed as needed. Although the direction of inclination is not known, this information is not necessary for the corrective action which must be taken.

In this way, a tool is provided which is automatic in its operation and simple in construction. A simple detection of pressure drop in drilling fluid at the pump indicates to the operator the amount of inclination of the drill bit so that corrections can be made. There are no wires transmitted to the surface or complicated signals which must be translated before the information can be understood.

The foregoing disclosure and description of the invention are illustrative and explanatory thereof, and various changes in the size, shape and materials as well as in the details of the illustrated construction may be made without departing from the spirit of the invention and all such changes are contemplated as falling within the scope of the appended claims.

I claim:

1. Well tool for detecting well bore deviation, comprising:

(a) a tool adapted to be connected between adjacent components of a drill string, including a longitudinal opening through which drilling fluid can be circulated;

(b) at least one vent hole in the tool wall for communicating the longitudinal opening with the space outside the tool through which drilling fluid is circulated back to the surface;

(c) blocking means for selectively blocking and unblocking the vent hole;

(d) deviation measuring means for measuring the angle the tool has deviated from vertical;

(e) timing and moving means operatively connecting the deviation measuring means with the blocking means for moving the blocking means and unblocking the vent at a time interval after weight is placed on a bit, the time interval being determined by the amount of deviation measured by the deviation measuring means, the unblocking of the vent causing a pressure drop in the drilling fluid in the tool the timing of which indicates the amount of deviation.

2. The well tool of claim 1, wherein the tool is adapted to be connected between the bit and an adjacent section of drill string.

3. The well tool of claim 1, wherein the tool includes upper and lower telescoping sections which can be stretched out when the bit is raised and compressed when weight is placed on the bit, the vent hole being formed in the upper section.

4. The well tool of claim 3, wherein the blocking means includes spaced apart upper and lower rings, with a space between the rings, connected to move together and located in a chamber in the housing around the longitudinal opening, the upper ring blocking the vent hole when the telescoping sections are stretched out.

5. The well tool of claim 4, wherein a fluid chamber is located in the upper section above the upper ring which expands and fills with hydraulic fluid when the upper section moves outwardly relative to the lower section and the upper ring, a one-way valve connecting the fluid chamber with a fluid reservoir for admitting fluid to the fluid chamber when it expands, the rings being connected to the lower telescoping section and prevented from moving upwardly with the upper section beyond a predetermined distance.

6. The well tool of claim 5, wherein a helical spring is located between the lower ring and the lower section for urging the rings upwardly, the compressive force of the spring being overcome when the upper section is lowered relative to the lower section.

7. The well tool of claim 6, wherein the timing and moving means includes a solenoid operated valve for allowing fluid in the fluid chamber to return to the reservoir after said time interval has elapsed so that the spring can move the rings upwardly when fluid returns to the reservoir, the axial opening communicating outside the housing when the space between the rings is adjacent to the vent hole and causing a pressure drop in drilling fluid in the tool.

8. The well tool of claim 7, wherein the lower ring blocks the vent hole when the sections are compressed and the spring extends to its normal position.

9. The well tool of claim 1, wherein the tool includes a plurality of radially disposed vent holes.

10. The well tool of claim 7, wherein the deviation measuring means includes a chamber in the tool partially filled with mercury, conductive wiring wound around the chamber above the mercury with the windings insulated from the tool and from each other, a non-conductive ring between the mercury and windings when the well tool is essentially vertical, means for transmitting electric current to the mercury, the wiring being connected to the timing and moving means, the current transmitted to the timing and moving means being proportional to the number of windings contacted by the mercury and reflecting the deviation of the tool from vertical.

11. The well tool of claim 10, wherein the timing and moving means includes a timing mechanism which receives current from the windings and transmits electric current to actuate the solenoid operated valve at an interval determined by the amount of current received from the windings.

* * * * *